US009644427B2

(12) United States Patent
Kvalvik

(10) Patent No.: US 9,644,427 B2
(45) Date of Patent: May 9, 2017

(54) DEVICE FOR DIRECTIONAL DRILLING

(75) Inventor: Tore Kvalvik, Stavanger (NO)

(73) Assignee: NABORS LUX FINANCE 2 SARL, Luxembourg (LU)

( * ) Notice: Subject to any disclaimer, the term of this patent is extended or adjusted under 35 U.S.C. 154(b) by 1100 days.

(21) Appl. No.: 13/469,111

(22) Filed: May 11, 2012

(65) Prior Publication Data

US 2012/0285746 A1 Nov. 15, 2012

(30) Foreign Application Priority Data

May 12, 2011 (NO) ..... 20110710

(51) Int. Cl.
*E21B 7/06* (2006.01)

(52) U.S. Cl.
CPC ..... *E21B 7/06* (2013.01); *E21B 7/062* (2013.01); *E21B 7/064* (2013.01)

(58) Field of Classification Search
CPC . E21B 7/06; E21B 7/064; E21B 7/067; E21B 7/10; E21B 7/04
USPC ..... 175/74
See application file for complete search history.

(56) References Cited

U.S. PATENT DOCUMENTS 4,729,675 A * 3/1988 Trzeciak ..... E21B 4/003 175/107
4,936,708 A * 6/1990 Perry ..... 405/184
5,875,859 A * 3/1999 Ikeda et al. ..... 175/73
6,092,610 A 7/2000 Kosmala et al.
6,234,259 B1 * 5/2001 Kuckes et al. ..... 175/73
6,244,361 B1 * 6/2001 Comeau ..... E21B 7/062 175/24
6,581,699 B1 6/2003 Chen et al.
6,769,499 B2 * 8/2004 Cargill et al. ..... 175/73
2002/0053470 A1 5/2002 Noe et al.
2002/0185315 A1 12/2002 McLoughlin
2003/0034178 A1 * 2/2003 Cargill ..... E21B 7/067 175/73
2006/0090935 A1 * 5/2006 Van Steenwyk et al. ..... 175/73
2008/0314644 A1 * 12/2008 Cayeux ..... 175/215
2009/0000826 A1 * 1/2009 Schuh ..... E21B 17/1014 175/325.1
2009/0050370 A1 * 2/2009 Peters ..... 175/45
2010/0236830 A1 * 9/2010 Haughom ..... 175/76

FOREIGN PATENT DOCUMENTS

EP 1479870 11/2009
GB 2334601 8/1999
WO WO96/31679 A 10/1996
WO WO2005/099424 10/2005
WO WO 2008/156375 12/2008

* cited by examiner

*Primary Examiner* — Robert E Fuller
*Assistant Examiner* — Christopher Sebesta
(74) *Attorney, Agent, or Firm* — Adolph Locklar

(57) ABSTRACT

A drill string section for directional drilling includes an outer casing which encases an adjustment mechanism for adjusting drilling direction and angular deflection during drilling. The adjustment mechanism has an outer shaft that is rotatably arranged relative to the outer casing and is configured with an axial eccentric first bore having a first bore axis that is parallel to the centre axis. The adjustment mechanism further includes an inner shaft that is rotatably arranged in the first bore and is configured with an axial, eccentric second bore for passage of a drive shaft for a drill bit.

18 Claims, 6 Drawing Sheets

SECTION C-C

SECTION B-B

SECTION A-A

SECTION C-C

SECTION B-B

SECTION A-A

SECTION C-C

DETAIL D

SECTION B-B

DEVICE FOR DIRECTIONAL DRILLING

FIELD OF THE INVENTION

The present invention relates to a drill string section for use in directional drilling.

BACKGROUND

When drilling oil and/or gas wells, it will often be necessary to guide the drilling tool in a desired direction out of the tool's drilling direction. This is the case, for example, in connection with directional wells which may have a substantial deviation from a vertical direction.

During drilling it is common to use a drill bit connected to a drill string, which drill string and drill bit are rotated about their longitudinal, axial axes by a drive unit which may be located at the surface.

Directional control of the drilling tool can be affected by applying to the drill bit a radial force which is designed to drive the bit to drill at a certain deviation in a desired direction in relation to the centre axis of the bit. The drilling tool may also have provided therein a gyroscope, one or more accelerometers or one or more magnetometers which give feedback on the position of the drill bit in the ground being drilled in.

With regard to directional drilling, it is common general knowledge that it can be done in two ways: either by so-called "point-the-bit", where the drill bit is "tilted" about a point in a desired drilling direction and at a desired angle relative to the centre axis of the drill bit, or by so-called "push-the-bit", where the drill bit is pushed sideways.

An example of a "point-the-bit" solution is described in U.S. Pat. No. 6,092,610. The disadvantage of this solution is that it requires continuous rotation of the bearings for the drill bit shaft at the same speed as, and in the opposite direction to, the drill string. Another example of a "point-the-bit" solution is described in U.S. Pat. No. 6,581,699 B1. The drawback of this solution is that it requires a great deal of force in order to bend the drill string, in addition to the possibility of problems of fatigue arising due to rotation whilst the shaft is bent.

A known "push-the-bit" device is described in WO 2008/156375, where three steering bodies are used that are arranged around the drilling tool in the circumferential direction and are movable in a radial direction in order to push the drill bit in the desired direction. The three steering bodies, which are individually movable, may, however, be subject to problems during operation, for example, leakages at the seals around the movable steering bodies.

Furthermore, WO 96/31679 teaches the use of two eccentric shafts for adjustment of drilling deviation. With this solution it is not possible to achieve a good adjustment in the opposite direction of the pregnant or weighted side 20. This means that the tool taught in this document is rather inflexible in use.

A tool is also known from GB 2334601 where eccentric shafts are used for adjustment of deviation and direction of the drilling tool. This is a "point-the-bit" solution which bends the drill string by means of eccentric rings between two stabilising units.

WO 2005/099424 describes a rotary gear mechanism that is used to control deviation and direction of the drilling tool. This document teaches that eccentric shafts are used to determine the magnitude of the deviation and the direction. However, this apparatus is constructed such that it is not possible to adjust direction and deviation separately; if direction is adjusted, deflection must also be adjusted or vice versa.

SUMMARY OF THE INVENTION

The object of the present invention is thus to provide a new and efficient device for controlling angle and deflection in directional drilling when using a "push-the-bit" device, which is arranged such that direction and deflection can be adjusted continuously, even whilst the drilling string rotates.

In accordance with the invention a drill string section for receiving a drill bit is provided. The drill string section being adapted for use in directional drilling in a borehole, wherein the centre axis of the drill bit is held parallel to the centre axis of the borehole and wherein the directional drilling is carried out in that the drill bit is parallel displaced by an adjustment mechanism that determines the drilling direction and angular deflection of the drill bit.

According to one aspect, the invention provides a drill string section for directional drilling, comprising an outer casing which encases an adjustment mechanism for adjusting drilling direction and angular deflection during drilling. The adjustment mechanism comprises an outer shaft having a first axial centre axis, which outer shaft is rotatably arranged in relation to the outer casing. The outer shaft is further configured with an axial, eccentric first bore having a first bore axis that is parallel to the first centre axis. The drill string section further comprises an inner shaft having a second axial centre axis, which inner shaft is rotatably arranged in the first bore, and is configured with an axial, eccentric second bore for passage of a drive shaft for a drill bit. The second bore has a second bore axis that is parallel to the second centre axis.

Further the centre axis of the drill bit is capable of parallel displacement relative to the outer casing and that the outer casing lies in abutment with the borehole or borehole casing when the drill string section is in use. Thus the outer casing is adapted for abutment with a borehole or borecasing.

The outer casing may be configured with return channels for return flow of drilling fluids. The outer casing may have a sleeve-like design with an axial extent in the axial direction of the drill string section to adapt for abutment with a bore hole or bore casing.

With this device for directional drilling there is no need for external moving parts, with the attendant possibilities of leakage in seals. This solution also gives a greater contact face against the formation, which may be advantageous when drilling in soft formations. Furthermore, since the new solution has the steering integrated in a stabiliser, the drill bit vibrations will be smaller, with the result that a better quality borehole is obtained.

The drill string section comprises, according to an embodiment of the invention, an outer rotational mechanism for reciprocal rotation of the outer casing and the outer shaft, and for locking the reciprocal rotary motion between the outer casing and the outer shaft, and an inner rotational mechanism for reciprocal rotation of the outer shaft and the inner shaft, and for locking the reciprocal rotary motion between the outer shaft and the inner shaft.

The outer rotational mechanism comprises a second motor which rotates the outer shaft or the outer casing, in order to cause reciprocal rotation between the outer casing and the outer shaft.

The inner rotational mechanism is, in principle, like the outer rotational mechanism, and comprises a first motor that rotates the outer shaft or the inner shaft, and causes reciprocal rotation between the outer shaft and the inner shaft.

Each shaft, the inner and the outer shaft, may also be rotated by using more than one motor for rotation of the shaft.

The first and the second motor may be electric or hydraulic actuators/motors which are supplied with electrical energy through a cable or the like from the surface. Alternatively, the energy may be supplied from a local accumulator/battery or a local generator which, for example, is driven by drilling fluids. The motors can be controlled from the surface in a way that is known to a person of skill in the art. Alternatively, the motors can be controlled in that they follow a pre-programmed path in the tool's processor. The pre-programmed path can be updated underway if so required by direct communication via cable, acoustics or alternatively via mud pulse.

The eccentricity of the first bore may be identical to that of the second bore. In the second bore, a drive shaft may be provided which is rotatably arranged in relation to the inner shaft. Mounted to the drive shaft is a drill bit. The drive shaft is preferably mounted to a rotor for rotation of the drill bit, the rotor being rotatably arranged in relation to the outer casing and the adjustment mechanism.

In order to help the drill string section to follow the well path when entering or exiting without it being necessary to carry out any active steering, the drill string section for instance the drive shaft may be provided with a flexible element which ensures that deviation in the well path can be absorbed by the drill string section. Advantageously, the flexible element can be constituted of a spring such as a radial spring, that is to say, a spring which compresses in the radial direction of the drill string section. In an embodiment of the invention, a first radial spring may be arranged around a lower portion of the drive shaft and a second radial spring may be arranged around an upper portion of the drive shaft.

To ensure that rotary motion between the outer casing and the outer shaft, and rotary motion between the outer shaft and the inner shaft are possible, there may, for example, be provided bushings between the surfaces that rotate in relation to each other.

The drill string section may be provided with an anti-rotational mechanism. The anti-rotational mechanism is preferably arranged in the outer casing and comprises at least one anti-rotational element that is movably arranged in the radial direction and projects from the radially outer surface of the outer casing. The anti-rotational element may be configured with a T-shaped cross-section and be arranged in a cavity in the outer casing such that the upright of the T projects from a slit which extends from the cavity and through the radially outer surface of the outer casing. Below the anti-rotational element is preferably arranged a spring element which is so adapted that is presses the anti-rotational element outwards in a radial direction. The spring element may, for example, be wave-shaped. Alternatively, the anti-rotational element may be configured as an arcuate or curved spring element. Furthermore, it may be advantageous to arrange a plurality of such anti-rotational mechanisms in the outer casing in order to prevent or at least reduce rotation of the outer casing relative to the surroundings.

BRIEF DESCRIPTION OF THE DRAWINGS

The invention will be described in more detail below with reference to the attached figures, wherein.

DETAILED DESCRIPTION

Figure 1A:
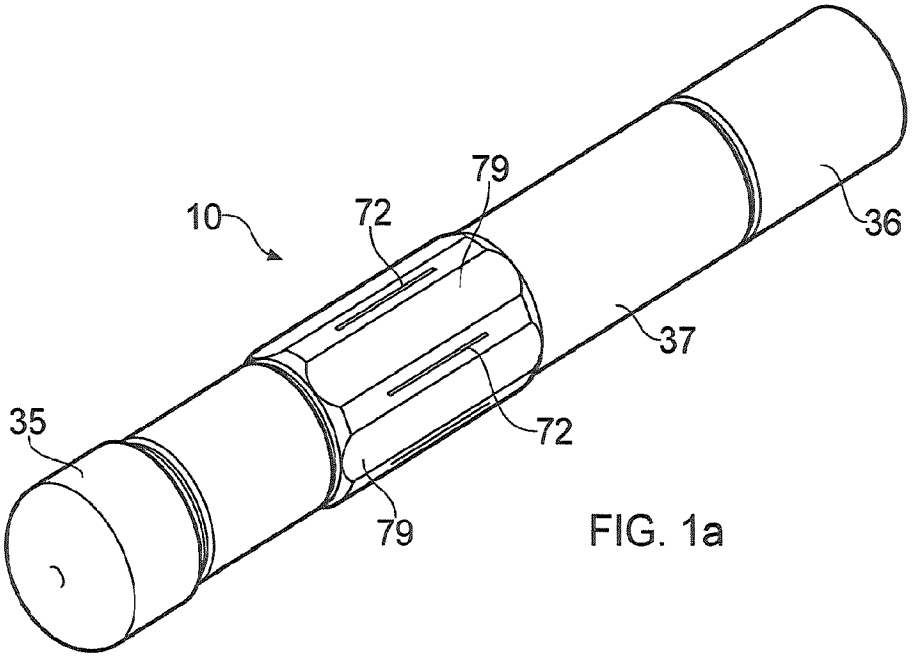
FIG. 1*a* shows a drill string section in the neutral position according to a first embodiment of the invention.

FIG. 1*a* shows a drill string having a drill string section 10 comprising a drill bit 35, a drill string section 10 with a rotational mechanism encased by an outer casing 37 in a neutral position, i.e., that the drill string section 10 is not set with any deviation from the centre axis of the drill string (drilling "straight ahead"). The drill string section 10 rests against the surroundings to give counterforce during directional drilling and to stabilise the drill bit, and is equipped with return channels 79 in the surface to allow for return flow of drilling fluids. The outer casing 37 of the drill string section 10 is also provided with one or more anti-rotational mechanisms 72 to prevent or at least reduce rotation of the outer casing in relation to the surroundings. It is not essential that the outer casing should be equipped with anti-rotational mechanisms 72 in order for it to have sufficient grip in relation to the surroundings, but their use may be desirable in some cases. The surroundings here may, for example, be a pipe in which the drill string section is arranged, or the ground in which drilling is taking place.

Figure 1C:
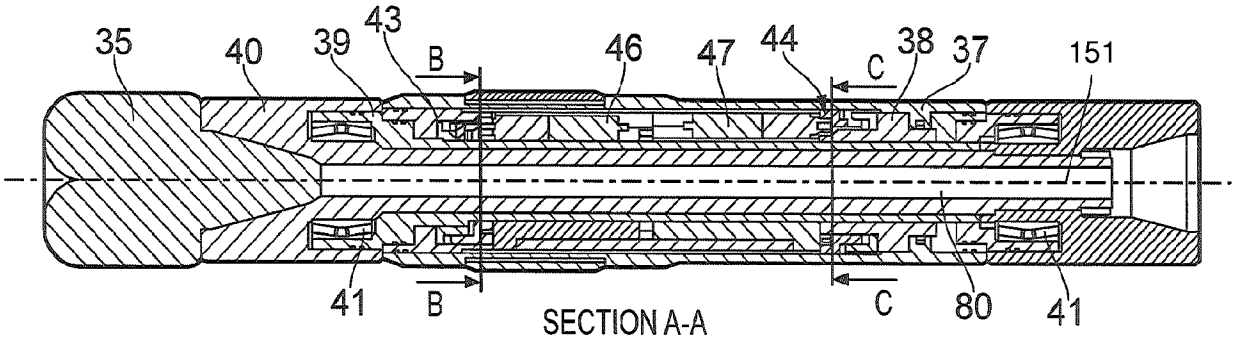
FIG. 1*c* shows the section A-A as indicated in FIG. 1*b*.
Figure 1B:
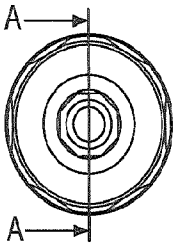
FIG. 1*b* shows the drill string section in FIG. 1*a*, from behind looking towards the drill bit.

FIG. 1*c* shows an axial section through the drill string shown in FIG. 1*a*. The drill bit 35 is attached to a drive shaft 40 which is configured with a bore 80 for supply of necessary drilling fluids during drilling, and attached to a drill string connector 36 as shown in FIG. 1*a* at the opposite end which connects the drill string section 10 to the drill string. Disposed between the drill bit 35 and the drill string connector 36 is an adjustment mechanism comprising an inner shaft 39, an outer shaft 38 lying external thereto and a surrounding casing 37. The inner shaft 39 and the outer shaft 38 may comprise the shape of sleeves. The drive shaft 40 is received in a bore that is eccentrically arranged in the inner shaft 39. The inner shaft 39 is rotatably arranged in relation to the drive shaft 40 on bearings 41. External to the inner shaft 39 there is further provided in the outer shaft 38 a bore that is eccentrically arranged in the outer shaft 38. Outermost, the outer casing 37 is arranged surrounding the outer shaft 38. According to one aspect of the invention, the outer casing 37, the outer shaft 38, and the inner shaft 39 have at all times parallel centre axes independent of how the adjustment mechanism is set for direction and angular deviation from the centre axis of the drill bit during drilling.

FIG. 1*c* also indicates an inner rotational mechanism 43 that causes reciprocal rotation of the inner shaft 39 and the outer shaft 38 when angular deflection of the directional drilling is to be adjusted. Similarly, an outer rotational mechanism 44 will cause reciprocal rotation between the outer shaft 38 and the outer casing 37 when the drilling direction is to be adjusted. The inner rotational mechanism 43 is located between the inner shaft 39 and the outer shaft 38 and the outer rotational mechanism 44 is located between the outer shaft 38 and the outer casing 37. The inner rotational mechanism 43 and the outer rotational mechanism 44 are also constructed such that they can lock against reciprocal rotation between the inner shaft 39 and the outer shaft 38, and the outer shaft 38 and the outer casing 37, respectively.

Figure 1E:
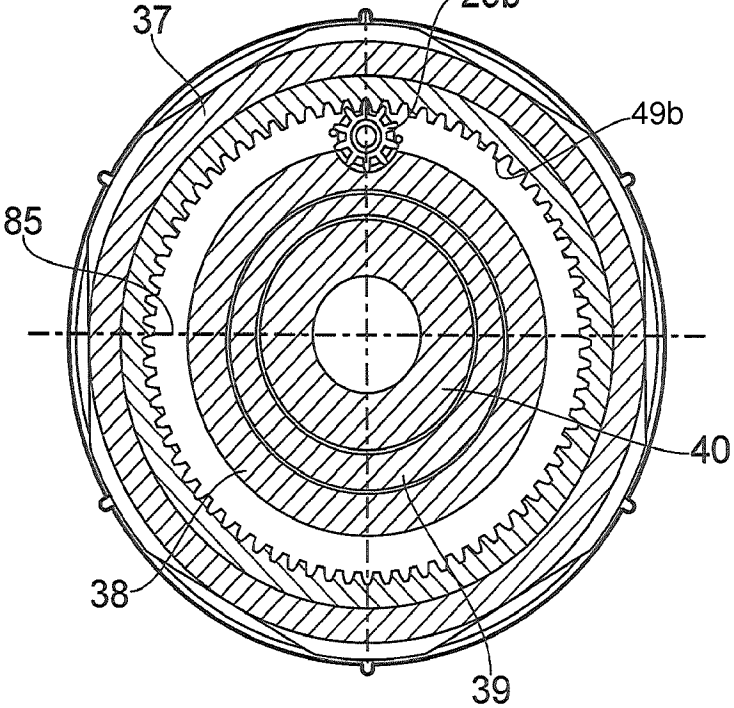
FIG. 1*e* shows the section C-C as indicated in FIG. 1*c*.
Figure 1D:
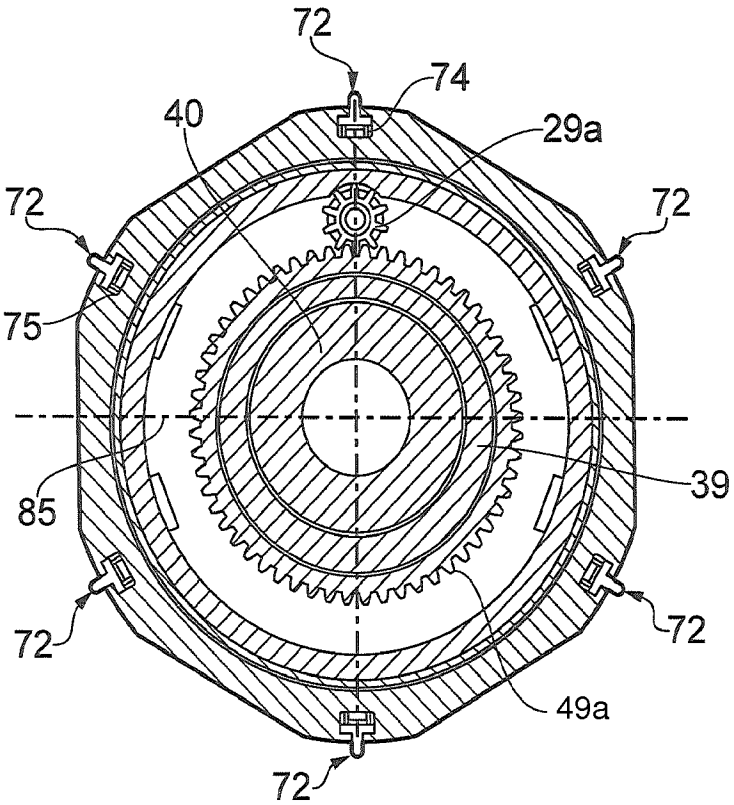
FIG. 1*d* shows the section B-B as indicated in FIG. 1*c*.

FIG. 1*d* shows the cross-section B-B that is indicated in FIG. 1*c*. Here it can be seen clearly that the drive shaft 40 lies innermost. External to the drive shaft 40 lies the inner shaft 39. External to the inner shaft 39 there is shown in this sectional view a gear rim 49*a* that is in engagement with a gearwheel 29*a* which is driven by a first motor 46. Externally lies the outer shaft 38 in which the first motor 46 is arranged.

FIG. 1*e* shows the cross-section C-C as indicated in FIG. 1*c*. The drive shaft 40 lies innermost as in FIG. 1*d*, with the inner shaft 39 located radially external thereto. Radially external to the inner shaft 39 lies the outer shaft 38. A gearwheel 29*b*, which is driven by a second motor 47, arranged in the outer shaft 38, is in engagement with the gear rim 49*b*. FIGS. 1*a-e* show a situation in which the inner shaft 39 and the outer shaft 38 have a position relative to one another such that their eccentricities cancel each other out, and during a drilling operation drilling will take place straight ahead.

Figure 2A:
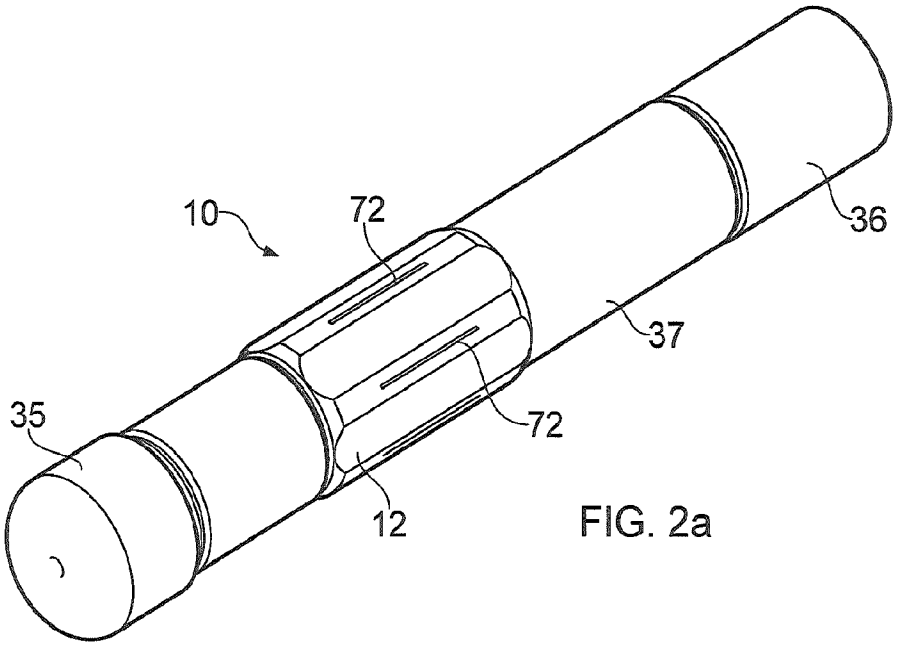
FIGS. 2*a-e* show the same embodiment of the drill string section as that shown in FIGS. 1*a-e*, but with deflection from the neutral position.
Figure 2C:
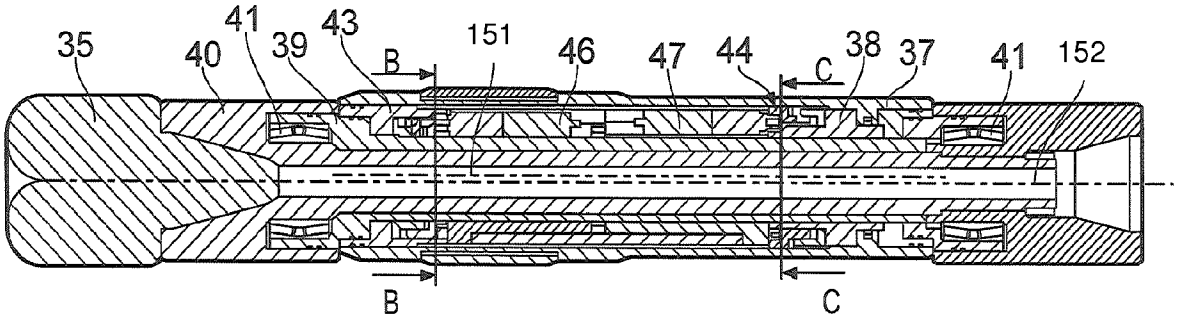
Figure 2B:
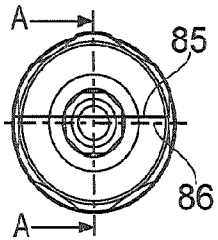
Figure 2E:
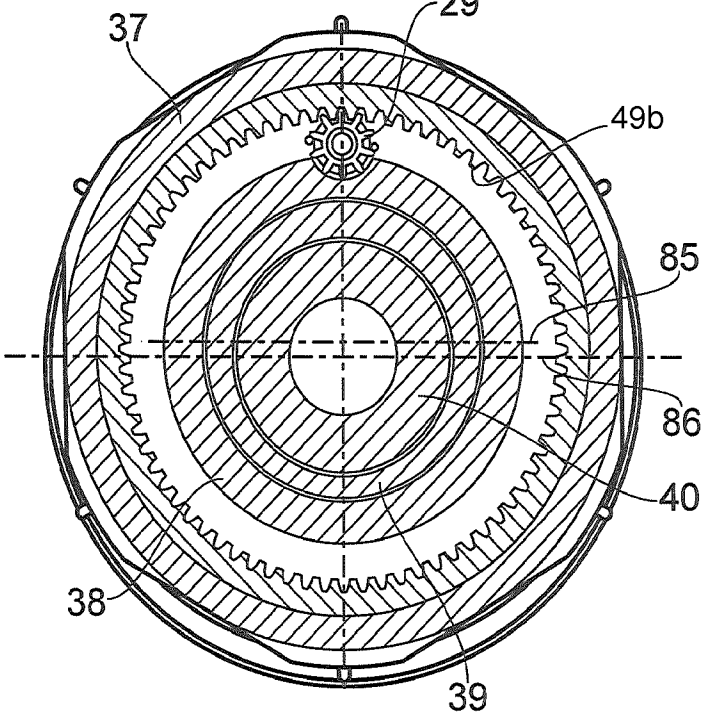
Figure 2D:
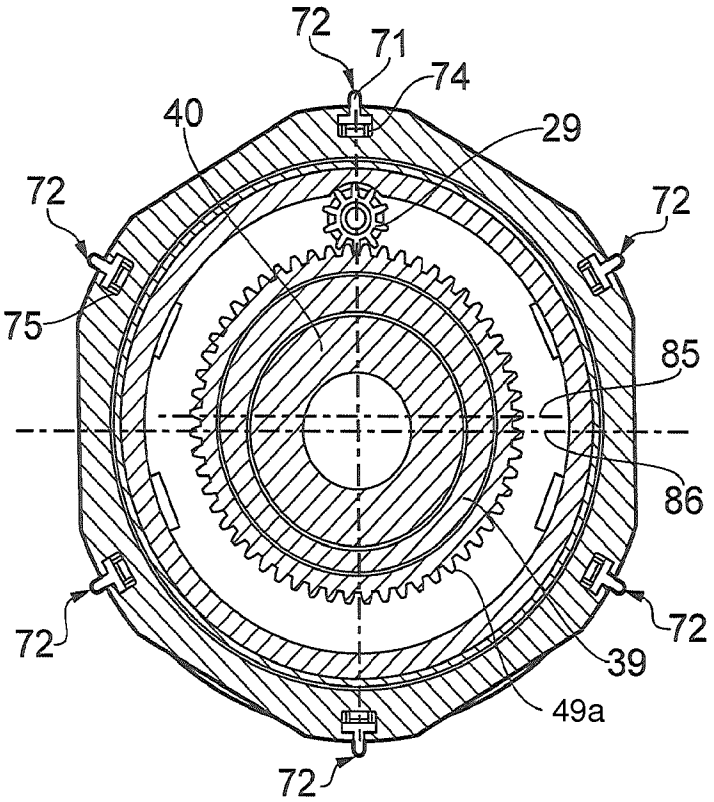

FIGS. 2*a-e* are the same device and the same sectional views as in FIGS. 1*a-e*, and therefore all the details will not be described again here. The difference between FIGS. 1*a-e* and FIGS. 2*a-e* is that in FIGS.2*a-e* the inner shaft 39 and the outer shaft 38 have been rotated in such a way relative to each other that their eccentricities are added up and give a vertical displacement relative to the neutral position in which drilling takes place straight ahead. In FIGS. 2*d-e*, this is indicated in that the centre axis of the drive shaft 40 has been lowered slightly to a horizontal level which is indicated by the reference numeral 86, as compared to the neutral position without deflection that is indicated by a horizontal level 85 which is also shown in FIGS. 1*d-e*. The centre axis 152 of the drill bit and the drive shaft in displaced state, as shown in FIGS. 2*b-c*, has been lowered slightly relative to the corresponding centre axis 151 in the neutral position in which no directional drilling takes place, i.e., drilling is carried out straight ahead. It should be noted that sideways displacement of the centre axis of the drive shaft can go in all directions, not only vertically as indicated in the attached figures.

Desired direction for the drilling and desired angular deflection can thus be obtained by adjusting the relative position between the inner shaft 39 and the outer shaft 38, and between the outer shaft 38 and the outer casing 37, such that the eccentricity of the inner shaft and that of the outer shaft allow a desired combination of drilling direction and deflection to be obtained.

FIGS. 1*d* and 2*d* also show the anti-rotational mechanism 72. The anti-rotational mechanism 72 is included to prevent or at least reduce rotation of the outer casing 37 in relation to the surroundings. The anti-rotational mechanism 72 comprises an anti-rotational element 71 which has a T-shape seen in a cross-section perpendicular to the axial direction of the drill string. The anti-rotational element 71 is arranged in a suitable cavity 75 in the outer casing 37 such that the upright of the T projects from a slit in the outer casing 37, which slit extends from the cavity 75 to the outside of the outer casing 37. The cross-bar of the T is movably arranged in a radial direction in the cavity 75. Below the anti-rotation element 71 is arranged a spring element, preferably in the form of a wave spring 74. The wave spring 74 presses the anti-rotational element 71 radially outwards and the anti-rotational element 71 will thus at least help to reduce rotation of the outer casing 37 in relation to the surroundings. A plurality of such anti-rotational mechanisms 72 are preferably arranged around the circumference of the outer casing 37.

Figures 3A, 3B, 3C, 3D, 3E:
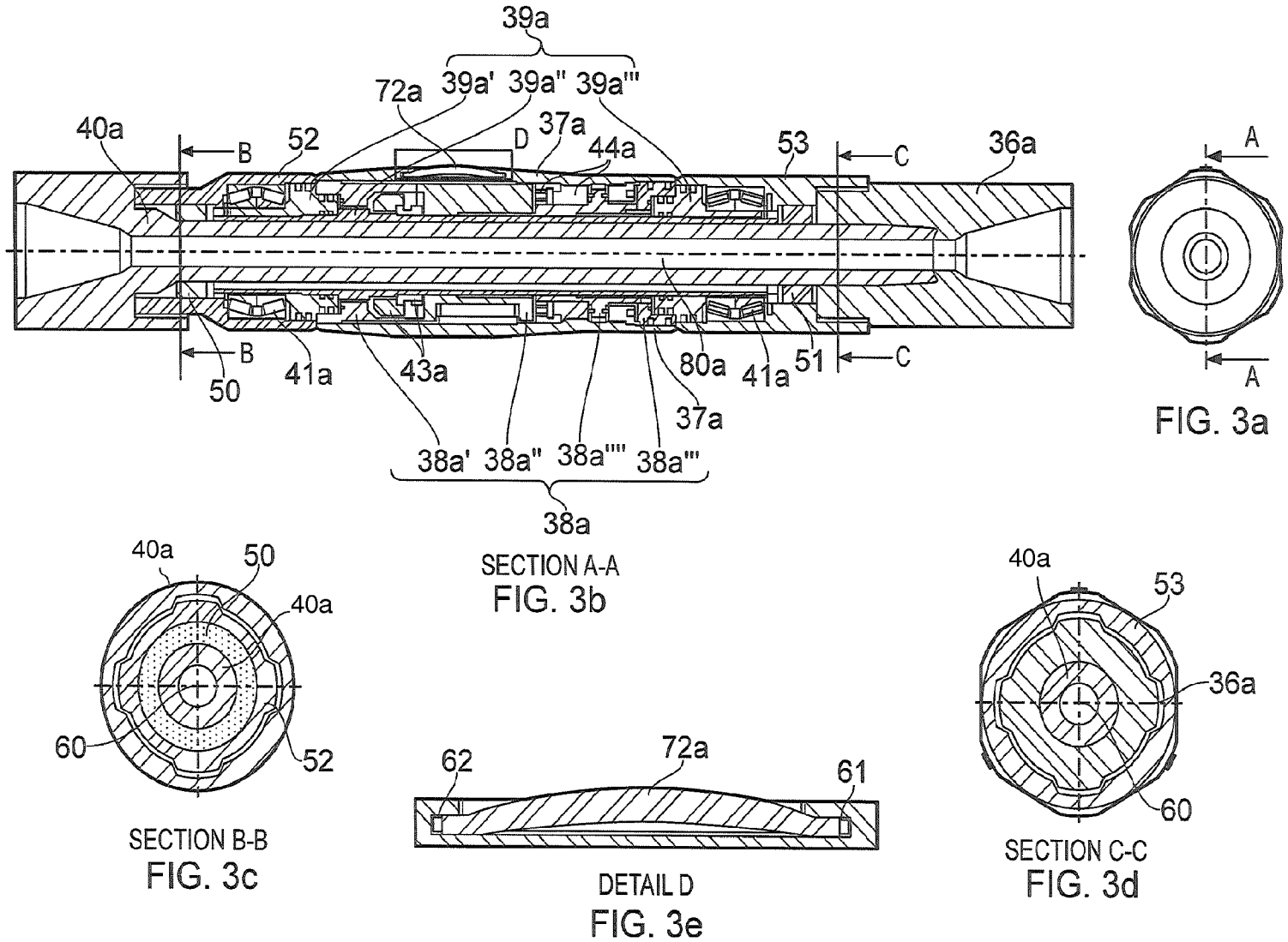
FIG. 3*a* shows a front view of a drill string section in the neutral position, according to a second embodiment of the invention.
FIG. 3*b* shows an axial view of the drill string section in FIG. 3*a*.
FIG. 3*c* shows the section B-B as indicated in FIG. 3*b*.
FIG. 3*d* shows the section C-C as indicated in FIG. 3*b*.
FIG. 3*e* shows the section D-D as indicated in FIG. 3*b*.

FIG. 3*b* shows an axial section of a second embodiment of the invention corresponding to FIG. 1*c*, but without the drill bit. The drill bit is to be attached to a drive shaft 40*a* that is configured with a bore 80*a* for supply of necessary drilling fluids during drilling, and attached to a drill string connector 36*a* at the opposite end which connects the drill string section 10 to the drill string. Disposed between the drill bit 35 and the drill string connector 36 is an adjustment mechanism comprising an inner shaft 39*a*, an outer shaft 38*a* lying external thereto and a surrounding outer casing 37*a*. The inner shaft 39*a*, as shown in FIG. 3*b*, works in the same way as the inner shaft according to the first embodiment of the invention, but is in this second embodiment shown comprising the following shaft parts, an inner shaft part 39*a*' and a first and second shaft part 39*a*" and 39*a*"' external thereto. The inner shaft 39*a* is configured with an eccentrically arranged bore for receiving the drive shaft 40*a*. The inner shaft 39*a* is rotatably arranged relative to the drive shaft 40*a* on bearings 41*a*. The outer shaft 38*a* is further arranged external to the inner shaft 39*a*. The outer shaft 3*a* is segmented but otherwise functions in the same way as the outer shaft 3 according to the first embodiment. In the embodiment shown in FIG. 3*b*, the outer shaft 3 is shown comprising the following shaft parts: first, second, third and fourth shaft part 38*a*', 38*a*", 38*a*'" and 38*a*"". The outer shaft 38*a* is configured with an eccentrically arranged bore for receiving the inner shaft 39*a*. Outermost, the outer casing 37*a* is arranged surrounding the outer shaft 38*a*. According to one aspect, the outer casing 37*a*, the outer shaft 38*a*, the inner shaft 39*a* and the drill bit shaft have at all times parallel centre axes independent of how the adjustment mechanism is set for direction and angular deviation from a centre axis of the drill bit during drilling.

FIG. 3*b* also indicates an inner rotational mechanism 43*a* which causes reciprocal rotation of the inner shaft 39*a* and the outer shaft 38*a* when the angular deflection of the directional drilling is to be adjusted. Similarly, an outer rotational mechanism 44*a* will cause reciprocal rotation between the outer shaft 38 and the outer casing 37*a* when the drilling direction is to be adjusted. The inner rotational mechanism 43*a* and the outer rotational mechanism 44*a* are also constructed such that they can lock against reciprocal rotation between the inner shaft 39*a* and the outer shaft 38*a*, and the outer shaft 38*a* and the outer casing 37*a*, respectively While there are no sectional views showing how rotation takes place with the aid of motors, gearwheels etc. as shown for the first embodiment in, inter alia, FIGS. 1*d*, 1*e*, one skilled in the art will recognize that a principle corresponding to that shown in FIGS. 1*e* and 1*d* will also apply to the second embodiment of the invention.

Radial springs 50 and 51 are arranged surrounding the drive shaft 40*a*. The springs 50, 51 ensure that the drill string section has a radial flexibility such that the drill string section can follow the possible bends and deviations of the well path without it being necessary to carry out active steering on entering and exiting the well. Each of the springs has a radial inside face which is secured to the drive shaft 40*a* and a radial outside face that is secured to its respective spring casing 52, 53. It can be seen from the sectional views in FIGS. 3*c* and 3*d* that the spring casings 52 and 53 have a matching configuration that fits cooperatively with projections and grooves in the drive shaft 40*a* and the drill string connector 36*a*. Furthermore, a gap is formed between the spring casing 52 and the drive shaft 40*a* at one end of the drill string section, and between the drill string connector 36*a* and the spring casing 53 at the other end of the drill string section. The gaps allow the drive shaft to be moved relative to its centre axis by compression of the radial springs, whilst the matching fit between the spring casing 52 and the drive shaft 40*a* and between the drill string connector 36*a* and the spring casing 53 ensures that the parts are prevented from twisting about the centre axis 60.

The drill string section according to the second embodiment as shown in FIG. 3*e* is provided with an anti-rotational mechanism 72*a* having a different embodiment than that shown in FIGS. 1*a*-1*e*. The anti-rotational mechanism 72*a* in this case is an arcuate or curved body that is secured to the casing 37*a* in that the opposing side edges of the arcuate or curved body are received in recesses 61, 62 made in the casing 37*a*. On abutment with a well wall, the curved body will be compressed and expand into recesses 61, 62 in the axial direction of the drill string section, such that the curve becomes flattened and a clamping effect outwards against the well wall is achieved.

Figure 4B:
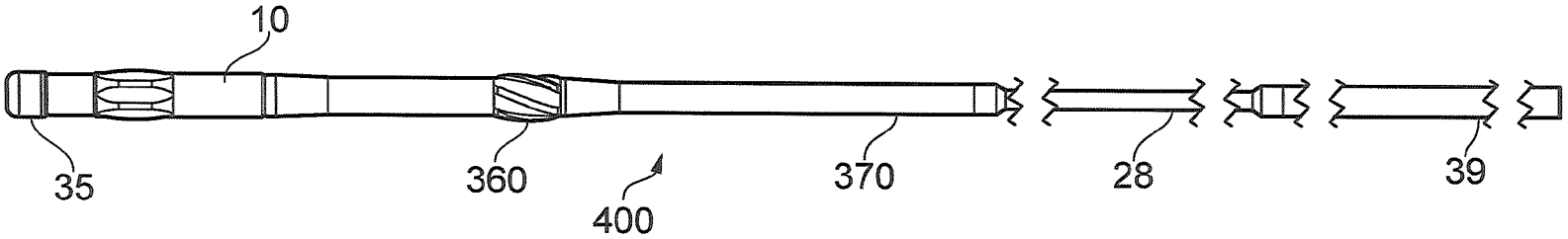
FIGS. 4*a* and 4*b* show an example of a BHA (Bottom Hole Assembly) with the drill string section included.
Figure 4A:
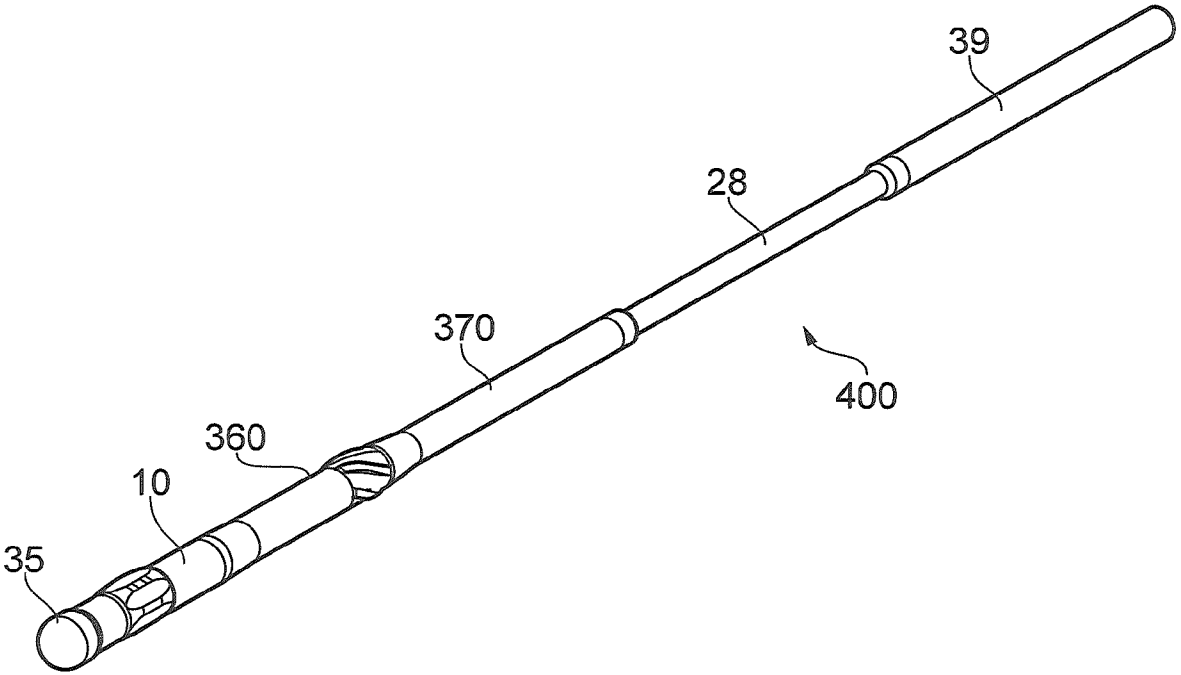

FIG. 4 shows an example of a BHA (Bottom Hole Assembly) 400 comprising drill string section 10 with drill bit 35 mounted on one end thereof. At the other end of the drill string section there is mounted a rotating stabilising unit 360 and arranged thereafter is a mud motor 370. The mud motor 370 increases the speed of the drill bit 35. The Bottom Hole Assembly/directional drilling tool 400 further includes a flexible connector 28 and a MWD (Measurement While Drilling)/LWD(Logging While Drilling) assembly 390 for measuring and logging drilling and formation data (pressure, temperature, density, gamma radiation etc).

The invention has been described here with reference to two embodiments thereof. It should be pointed out that several interpretations of the invention are possible within the scope of the patent claims.

The invention claimed is:

1. A drill string section for receiving and directionally controlling a drill bit, comprising:

an outer casing adapted for abutment with a borehole or borecasing, the outer casing having a drive shaft arranged therein, the drive shaft adapted to receive a drill bit, the drive shaft having a drive shaft centre axis and further capable of parallel displacement relative to the outer casing, said outer casing further housing an adjustment mechanism, said adjustment mechanism comprising:

an outer shaft having a first axial centre axis, wherein the outer shaft is arranged to be rotated relative to the outer casing, and wherein the outer shaft is configured with an axial eccentric first bore having a first bore axis that is parallel to the first centre axis; and an inner shaft having a second axial centre axis, wherein the inner shaft is positioned in the first bore and arranged to be rotated relative to the outer shaft, and wherein the inner shaft is configured with an axial eccentric second bore for passage of the drive shaft for driving the drill bit, wherein the second bore has a second bore axis that is parallel to the second centre axis;

wherein rotation of one or more of the inner or outer shafts alters the relative position of their respective eccentricities, thereby causing the drive shaft to undergo parallel displacement to drill a deviated section of a wellbore, wherein while inducing parallel displacement of the drive shaft, the drive shaft centre axis of the drive shaft, the first axial centre axis and the first bore axis of the outer shaft, and second axial centre axis and second bore axis of the inner shaft are parallel.

2. A drill string section according to claim 1, wherein the outer casing further comprises return channels for return flow of drilling fluids.

3. A drill string section according claim 1, wherein the eccentricity of the first bore is identical to the eccentricity of the second bore.

4. A drill string section according to claim 1, wherein the drive shaft is arranged in the second bore rotatable relative to the inner shaft.

5. A drill string section according to claim 1, wherein the drive shaft comprises a flexible element which permits a radial motion of the drive shaft.

6. A drill string section according to claim 5, wherein the flexible element is one or more springs.

7. A drill string section according to claim 6, wherein the one or more springs comprise a first radial spring and a second radial spring, the first radial spring arranged around a lower portion of the drive shaft and the second radial spring arranged around an upper portion of the drive shaft.

8. A drill string section according claim 1, wherein the outer casing has a sleeve-like design with an axial extent in the axial direction of the drill string section.

9. A drill string section according to claim 1, wherein the adjustment mechanism comprises an outer rotational mechanism for reciprocal rotation of the outer casing and the outer shaft, and which is adapted for locking against reciprocal rotary motion between the outer casing and the outer shaft;

an inner rotational mechanism for reciprocal rotation of the outer shaft and the inner shaft, and which is adapted for reciprocal rotary motion between the outer shaft and the inner shaft.

10. A drill string section according to claim 9, wherein the inner rotational mechanism comprises a first motor and the outer rotational mechanism comprises a second motor.

11. A drill string section according to claim 10, wherein the first and second motors are electric motors.

12. A drill string section according to claim 10, wherein the first and second motors are hydraulic motors.

13. A drill string section according to claim 12, wherein the anti-rotational mechanism includes a spring element adapted to press the anti-rotation element outward in a radial direction.

14. A drill string section according to claim 1, wherein the outer casing comprises an anti-rotational mechanism.

15. A drill string section according to claim 14, wherein the anti-rotational mechanism comprises an anti-rotational element movably arranged in the radial direction, wherein the anti-rotation element has a T-shaped cross-section and is arranged in a cavity formed in the outer casing such that the anti-rotation element projects from a slit which extends from the cavity and through the radially outer surface of the outer casing.

16. A drill string section according to claim 14, wherein the anti-rotational mechanism comprises an anti-rotational element, the anti-rotational element being an arcuate or curved spring element.

17. A drill string section according to claim 14, comprising two or more anti-rotational mechanisms.

18. A drill string section according to claim 1, wherein the outer casing includes one or more return channels for return flow of drilling fluids.

* * * * *